US005555580A

United States Patent [19]

Hsia

[11] Patent Number: 5,555,580

[45] Date of Patent: Sep. 17, 1996

[54] WATER BED WITH INNER COMMUNICABLE AIR CHAMBERS

[76] Inventor: Yu Chun Hsia, No. 3, Chiao Ai 9th Road, Hsin Tien City, Taipei Hsien, Taiwan

[21] Appl. No.: 508,682

[22] Filed: Jul. 28, 1995

[51] Int. Cl.[6] ..... A47C 27/10

[52] U.S. Cl. ..... 5/665

[58] Field of Search ..... 5/451, 452, 455, 5/449, 450

[56] References Cited

U.S. PATENT DOCUMENTS

| | | | |
|---|---|---|---|
| 4,168,555 | 9/1979 | Benjamin | 5/452 |
| 4,558,476 | 12/1985 | Linder | 5/450 |
| 4,611,357 | 4/1986 | Chelin | 5/451 |
| 4,638,518 | 1/1987 | Barbulla | 5/451 |
| 4,727,607 | 3/1988 | Nystad | 5/451 |

*Primary Examiner*—Alexander Grosz
*Attorney, Agent, or Firm*—Morton J. Rosenberg; David I. Klein

[57] ABSTRACT

A water bed having inner communicable air chambers is provided. The water bed has a mattress body formed of an upper and a lower sheet with an air inlet, a water inlet, and an air vent provided thereon. A plurality of mutually communicable long air chambers arranged in parallel are sealed inside the mattress body by means of radioheating to longitudinally divide an inner space of the mattress body into a plurality of alternate air and water passages. The air chambers each have an oval-shaped cross-sectional contour that permits the air chambers to change their shape in accordance with the amount of air filled therein. The mattress body is thereby maintained in a soft, elastic, stable condition. The air chambers reduce the amount of water required to fill the mattress body and thereby reduce the weight of the mattress body and shorten the time required to heat or cool the water bed.

1 Claim, 4 Drawing Sheets

WATER BED WITH INNER COMMUNICABLE AIR CHAMBERS

BACKGROUND OF THE INVENTION

The present invention relates to a water bed with inner communicable air chambers, and more particularly to a water bed in which a plurality of parallelly arranged air chambers are connected thereto by means of radioheating to divide the space in the water bed into a plurality of communicable water passages. The water bed according to the present invention can quickly adapt to and moderate any pressure locally applied on the water bed while the whole weight and the time required to heat or cool the water bed can be largely reduced.

To sleep in a more comfortable manner, people usually put a spring mattress on a bed to increase the softness and elasticity of the bed. Such spring mattress is, however, not temperature-adjustable with changes in the ambient environment. Particularly in summer time, it is very uncomfortable to sleep on such spring mattress.

The water bed is developed to eliminate the disadvantages existed in the conventional spring or other types of mattress. There are also many patents or patent applications disclosing different ways to improve the conventional water mattresses. Most of the commercially available water beds are formed of an upper and a lower plastic sheets sealed together by means of radioheating. A plurality of single-layered diaphragms are further connected to and between these two sheets by means of radioheating with a purpose to maintain the water bed in a stable condition when the same is subjected to pressure which will usually cause the water bed to waver badly. The single-layered diaphragms can be designed to have a V- or X-figured cross section to enhance their ability in controlling the stability of the water bed. Alternatively, protective wall in a form of air belt is provided around the water bed to moderate any sway of the bed due to waving of water inside the bed. Following are the disadvantages existed in the conventional water beds:

1. The single-layered plastic diaphragms do not have enough tensile stress and will therefore tighten the upper and the lower sheets of the water bed when they are subjected to an outcoming pressure, causing the water bed to be of less soft and less elastic.
2. There is no substance of high compression ratio provided with the water bed to evenly absorb a pressure locally impacting on the water bed. Or, any waver of the bed caused by waving water inside the bed can be moderated only when the waver has been transmitted to the peripheral air belt of the water bed. So, the whole water bed is still subjected to a prolonged and very big impact from the waving water inside the bed.
3. The whole water bed is filled with water and can be as heavy as several hundred kilograms which prevents the bed from being conveniently moved when necessary. It is extremely time and energy consuming to adjust the temperature of water bed with so many water inside it.

It is therefore tried by the inventor to develop a water bed with inner communicable air chambers to further improve the conventional water beds.

SUMMARY OF THE INVENTION

A primary object of the present invention is to provide a water bed in which a plurality of air chambers filled with air are provided so that these air chambers, when they are subjected to pressure, can be changed in their volume and tensed shape with the help of the filled air of high compression ratio, and therefore, always permit the water bed in a soft and elastic status.

Another object of the present invention is to provide a water bed with inner communicable air chambers so that air of high compression ratio can be filled and evenly distributed to every portions of the water bed to quickly and evenly moderate any local strong impacting wave occurred due to fierce movements made by a user on the water bed.

A further object of the present invention is to provide a water bed with inner communicable air chambers wherein an inner space of the water bed is occupied by the air chambers that largely reduces water required to fill the water bed and thereby reduces the weight thereof and shorten the time required to heat or cool the water bed.

A still further object of the present invention is to provide a water bed with inner communicable air chambers wherein air of different compression ratio can be filled into the air chambers to adjust the softness of the water bed.

DETAILED DESCRIPTION OF THE PREFERRED EMBODIMENT

Figure 1:
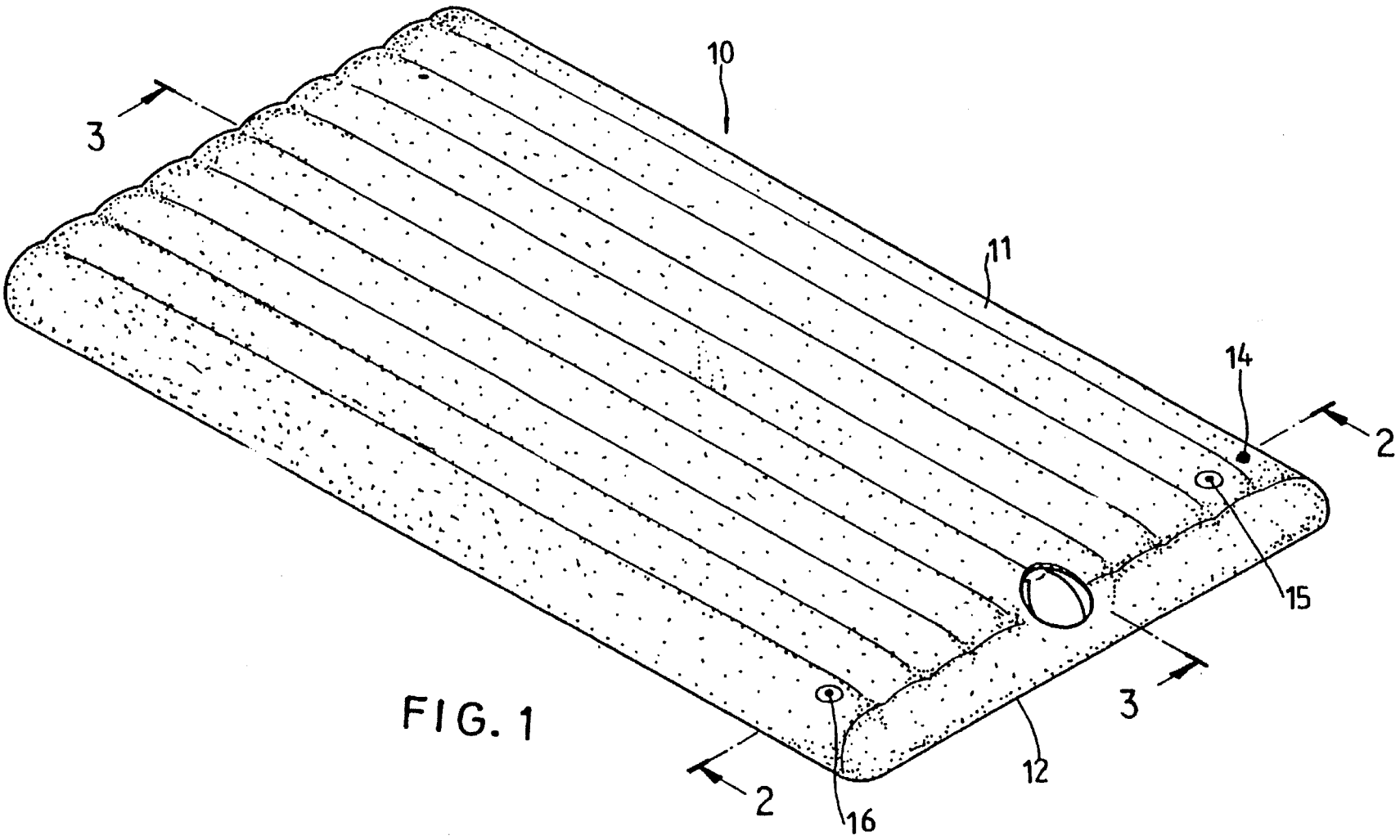
FIG. 1 is a perspective view of a water bed according to the present invention.
Figure 2:
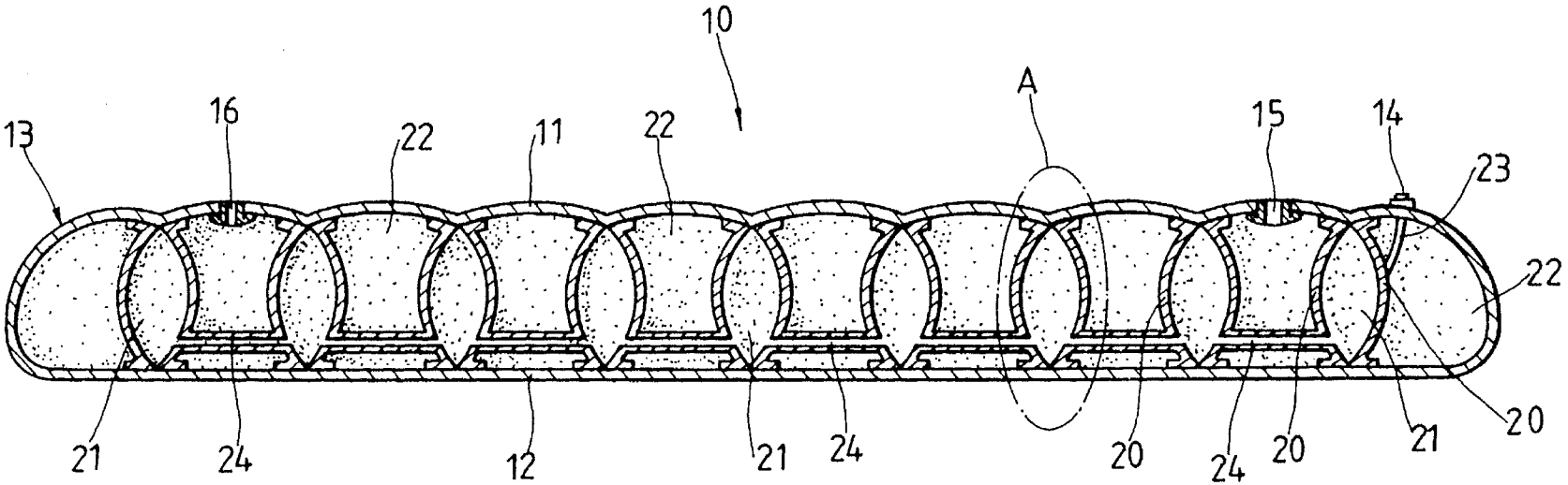
FIG. 2 is a cross sectional view taken on line 2—2 of FIG. 1.
Figure 3:
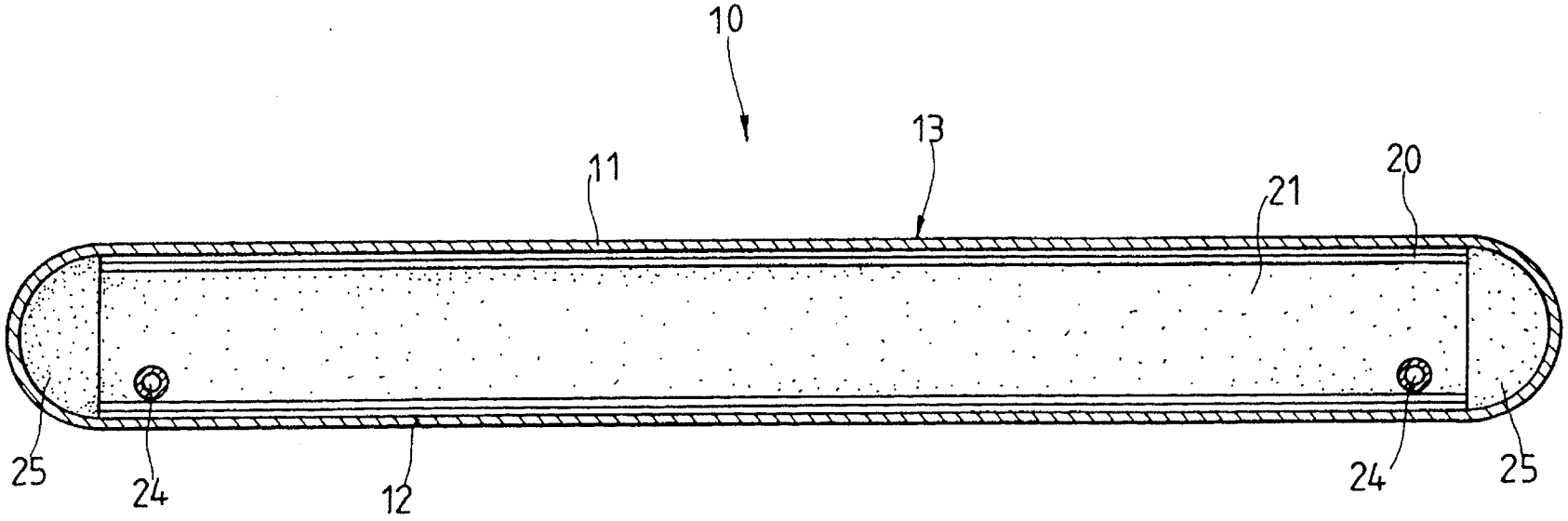
FIG. 3 is a cross sectional view taken on line 3—3 of FIG. 1.
Figure 4:
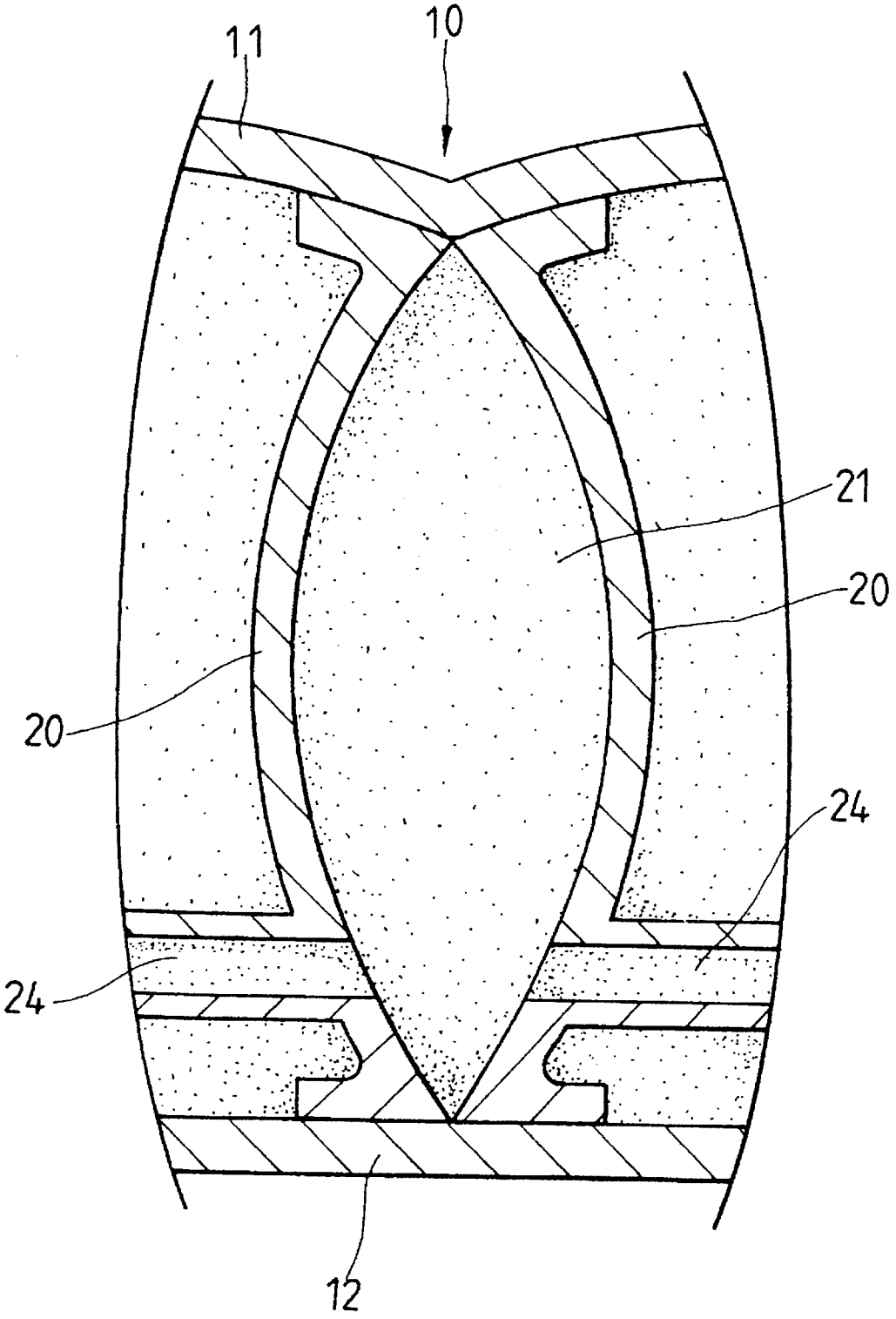
FIG. 4 is a fragmentary, enlarged, sectional view of an air chamber of the present invention.

Please refer to FIGS. 1 through 4. The present invention relates to a water bed 10 which is a completely closed mattress 13 formed from an upper sheet 11 and a lower sheet 12 being sealed together by means of radioheating. An air inlet 13, a water inlet 15, and an air vent 16 are provided on the mattress 13 at suitable positions. The mattress 13 has four rounded peripheral edges and corners. A plurality of long air chambers 21 are parallelly arranged inside the mattress 13 at predetermined intervals to extend almost a full length of the mattress 13 and are sealed to and between the upper and the lower sheets 11, 12 by means of radioheating. As shown in FIGS. 2 and 4, the air chambers 21 have an oval-shaped cross section which allows the air chambers to change their diameter with an amount of air filled thereinto and a pressure they are subjected. The air chambers 21 divide an inner space of the mattress 13 into a plurality of alternate water passages 22. The air chambers 21 do not extend from the very beginning of the mattress 13 to the very end thereof such that a communicating water passage 25 is formed inside the mattress 13 along the rounded periphery thereof to surround the parallelly arranged air chambers 21.

A tube 23 having one end connected to the, air inlet 14 and another end connected to an air chamber 21 located at outer side of the parallelly arranged air chambers 21.

A plurality of transversely extended communicating channels 24 are provided near a bottom portion of the parallelly arranged air chambers 21 at a certain intervals, permitting the air chambers 21 to be inflated more quickly.

Water can be filled into the mattress 13 via the water inlet 15. The air vent 16 is opened when water is filled into the mattress 13 via the water inlet 15 to expel air out of the water passages 22.

FIGS. 2 and 3 illustrate a cross sectional view and a side sectional view, respectively, of a fully inflated and water-filled water bed 10. As shown in the drawings, the inflated air chambers 21 and water-filled water passages 22 alternate with each other in the mattress 13 and expand the same, allowing the water bed 10 to maintain in a desired stable status. When any movement on the water bed 10 depresses the upper sheet 11 thereof and produces a local high-pressure impacting wave in the water passages 22, the mutually connected and communicable air chambers 21 filled with air of high compression ratio and evenly disposed inside the mattress 13 shall quickly moderate any of such local high-pressure impacting wave and restore the water bed 10 to a stable status.

Moreover, the alternately disposed air chambers 21 and water passages 22 largely reduce the space inside the mattress 13 occupied by water. As a result, the whole water bed 10 has a reduced weight and water in the mattress 13 can be heated or cooled within a largely shortened time.

It is to be understood that the form of the invention shown and disclosed is to be taken as a preferred embodiment of the invention and that various changes in the shape, size, and arrangement of parts may be resorted to without departing from the spirit of the invention or the scope of the subjoined claims.

What is claimed is:

1. A water bed having inner communicable air chambers, comprising:

a mattress body formed from an upper sheet and a lower sheet sealed together by means of radioheating, said mattress body having an air inlet, a water inlet, and an air vent formed thereon at predetermined positions, said mattress body having four rounded peripheral edges and corners;

a plurality of long air chambers arranged in parallel inside said mattress body at predetermined intervals and being sealed to and between said upper and said lower sheets of said mattress body by means of radioheating, said air chambers having an oval-shaped cross-sectional contour which allows said air chambers to change their diameter in accordance with an amount of air filled therein and external pressures applied thereto, said air chambers dividing an inner space of said mattress body into a plurality of alternate air and water passages, said air chambers extending less than the full length of said mattress body such that a communicating water passage is formed inside said mattress body along said rounded periphery inside said mattress body along said rounded periphery thereof to surround said parallel arrangement of air chambers;

a tube having one end connected to said air inlet and another end connected to one of said air chambers, said one end being located at an outer side of said parallel arrangement of air chambers for inflating said air chambers; and a plurality of transversely extended communicating channels being integrally provided near a bottom portion of said parallel arrangement of air chambers at predetermined intervals for permitting said air chambers to be inflated more quickly;

whereby air can be filled into said air chambers via said air inlet and water can be filled into said water passages via said water inlet while said air vent is opened to let out any air displaced from inside said water passages, permitting said mattress body to be maintained in a soft, elastic, stable condition and to have a reduced weight due to said air chambers occupying a large space in said mattress body to reduce an amount of water required to fill the mattress body.

* * * * *